US008011037B1

(12) United States Patent
Earnest

(10) Patent No.: US 8,011,037 B1
(45) Date of Patent: Sep. 6, 2011

(54) SWADDLE

(76) Inventor: Tamara Walker Earnest, Estero, FL (US)

( * ) Notice: Subject to any disclaimer, the term of this patent is extended or adjusted under 35 U.S.C. 154(b) by 0 days.

(21) Appl. No.: 12/824,895

(22) Filed: Jun. 28, 2010

Related U.S. Application Data

(63) Continuation-in-part of application No. 12/772,978, filed on May 3, 2010, now abandoned, and a continuation-in-part of application No. 12/773,821, filed on May 4, 2010, now Pat. No. 7,954,187.

(60) Provisional application No. 61/221,059, filed on Jun. 28, 2009.

(51) Int. Cl.
*A47G 9/02* (2006.01)

(52) U.S. Cl. ..... 5/494; 5/482; 5/498; 2/69; 2/69.5; 128/872

(58) Field of Classification Search ..... 5/494, 413 R, 5/655, 482; 2/69.5, 69
See application file for complete search history.

(56) References Cited

U.S. PATENT DOCUMENTS 4,680,030 A * 7/1987 Coates et al. ..... 604/391
4,979,250 A * 12/1990 Troncone et al. ..... 5/494
5,016,650 A * 5/1991 Marlar ..... 128/878
5,129,406 A 7/1992 Magnusen
5,640,717 A * 6/1997 Ray ..... 2/69
6,009,576 A * 1/2000 Gramme et al. ..... 5/413 R
6,393,612 B1 5/2002 Thach
6,662,390 B1 * 12/2003 Berger ..... 5/486
6,817,033 B2 * 11/2004 Bailey ..... 2/69.5
6,868,566 B2 3/2005 Gatten
6,928,674 B2 * 8/2005 Blackburn ..... 5/482
7,043,783 B2 5/2006 Gatten
7,181,789 B2 * 2/2007 Gatten ..... 5/494
7,246,392 B2 * 7/2007 Schmid et al. ..... 5/655
7,587,769 B1 * 9/2009 McDermott ..... 5/494
2004/0158925 A1 * 8/2004 Sims ..... 5/494
2004/0216230 A1 * 11/2004 Blackburn ..... 5/482
2006/0010600 A1 * 1/2006 Kendy ..... 5/482
2007/0056098 A1 * 3/2007 Schmid et al. ..... 5/482
2009/0249526 A1 * 10/2009 Carangelo ..... 2/69.5
2010/0071709 A1 * 3/2010 Grissom ..... 5/494
2010/0275373 A1 * 11/2010 Kaplan et al. ..... 5/494

OTHER PUBLICATIONS

Swaddle Sleeve, Original Swaddle Sleeve in Pink Fleece with Brown Trim, Etsy.com, Apr. 2, 2009, USA.

* cited by examiner

*Primary Examiner* — Robert G Santos
*Assistant Examiner* — Brittany Wilson
(74) *Attorney, Agent, or Firm* — The Livingston Firm; Edward M. Livingston, Esq.; Bryan L. Loeffler, Esq.

(57) ABSTRACT

A swaddle wrap to calm and comfort an infant has two panels. One that is both wide and long enough to wrap entirely both of the infant's arms and a second one to then wrap around the infant's torso and secured arms that then are attached between the legs. Hook and loop fasteners are used to secure the arm restraints, the swaddle and to attach both panels between the legs.

5 Claims, 3 Drawing Sheets

SWADDLE

CROSS REFERENCE TO RELATED APPLICATIONS

This application claims the benefit of U.S. Provisional Patent Application No. 61/221,059, filed Jun. 28, 2009. The patent application identified above is incorporated herein by reference in its entirety to provide continuity of disclosure.

The present application is a continuation-in-part application of U.S. patent application Ser. No. 12/772,978, filed May 3, 2010, now abandoned for SWADDLE WRAP, by Tamara Walker Earnest.

The present application is a continuation-in-part application of U.S. patent application Ser. No. 12/773,821, filed May 4, 2010, now U.S. Pat. No. 7,954,187 for SWADDLE ACCESSORY, by Tamara Walker Earnest.

FIELD OF THE INVENTION

The present invention relates to garments for infants and, more particularly, swaddling blankets.

BACKGROUND OF THE INVENTION

Swaddling of infants has been practiced for thousands of years. Swaddling is the wrapping or binding of an infant.

Swaddling provides many benefits. Newborns can have trouble regulating their body temperature. Swaddling keeps an infant warm and allows a caregiver to handle and carry an infant more easily. It is believed that swaddling comforts the infant and allows them to sleep more soundly. The snugness of the swaddle may remind them of the confinement of the womb and provides comfort and a sense of security. Swaddling with the arms bound also helps prevents an infant from waking due to their startle reflex. Pressure across the abdominal and chest area has a calming effect and is thought to relieve colic. Swaddling has been used more recently in the calming of older children that may have special needs.

The suggested positioning for an infant to sleep to reduce the risk of SIDS is on their back. Some infants do not tolerate sleeping on their back well unless they are swaddled.

The preferred method of swaddling is to keep the infant's arms at their sides while providing even, gentle pressure across the chest and abdominal area. However, infants rarely keep their arms at their sides and are able to break out of traditional swaddles. Due to startle reflexes, they startle themselves awake. A snug swaddle can make an infant less restless. Also, once they get their arms up by their chest or mouth, their rooting reflex kicks in and can interrupt their sleep. Older children are much stronger and can break out of a swaddle easily.

Another problem with not being able to keep the infant's arms at their sides is that they can work loose a blanket or swaddle device and it may migrate over their face causing a risk of suffocation, or strangulation. Also, swaddling can pose a risk to an infant if they are wrapped too tight to inhibit normal breathing. Immobilization of the legs may promote hip dysplasia.

Although most infants are only swaddled for 3-4 months, some require swaddling well past that age to sleep more soundly. A swaddle that comes loose may make an infant restless and interrupt their sleep. Some infants don't like having their legs contained and will become restless attempting to kick out of the swaddle. Older babies are stronger and are much harder to keep from breaking out of their swaddle.

Infants in a hospital setting sometimes need their arms immobilized to prevent them from inadvertently pulling out tubes, IV's or disconnecting other medical monitoring devices.

Overheating is also a risk related to swaddling. Overheating can contribute to an increased risk of SIDS.

Diaper changes usually require the infant to be un-swaddled and then re-swaddled, unnecessarily awakening the infant.

Some infants, particularly those with reflux, sleep better in an upright position, like in a bouncy seat or swing. However, the infant tends to scoot down in the seat making it possible for the traditional swaddles or blankets to migrate over their face causing a suffocation hazard.

An ideal execution of swaddling would provide a way to keep the infant's arms fixed at their sides, provide gentle even pressure across the chest and abdominal area, reduce the risk of overheating, provide easy access for diaper changes and provide a method for keeping the swaddle or blanket from migrating up over the face.

There are several patented swaddling devices in the prior art that have built-in arm restraints to attempt to keep the infant from breaking out of his swaddle.

The shortcomings of the prior art are either one of or a combination of the following:

- They do not properly contain an infant's arms. The arm restraints are lacking in function. Either they are a preformed sleeve or pocket that is extremely difficult to insert an infant's arm through, or they are lacking any fasteners (such as hook and loop) to keep the arm restraint in place and inescapable for a wiggly infant, or they fail to keep the infant's arms in the preferred position, at their sides.
- They do not provide easy access for diaper changes. Having to unswaddle an infant in the middle of the night to change a soiled diaper can unnecessarily awaken a sleeping infant.
- They can be cumbersome or must be wrapped around the infant too many times. Wrapping the infant several times puts them at risk for overheating. Overheating can contribute to an increased risk of SIDS.
- A full swaddle when combined with full body sleeping attire may also put the infant at risk for overheating.
- If bound too tight in order to attempt to keep the infant from breaking free, a swaddle can inhibit chest wall movement, compromising an infant's ability to breathe normally.
- If the swaddle binds the infant's legs preventing them from flexing and abducting normally, this may lead to the development of hip dysplasia.
- The swaddle isn't secured with fasteners (such as hook and loop) making it easy for an infant to break loose putting the infant at risk for strangulation or suffocation.
- The swaddle is easily able to migrate over the infant's face while in an upright position, putting them at risk for suffocation.

The present invention remedies the defects of known swaddles by providing an easy to use swaddle that keeps the infant's arms secured in the preferred position, at their sides, provides even gentle pressure across the chest and abdominal area, allows easy access for diaper changes, only wraps the infant once to reduce the risk of overheating, allows free movement of the legs to reduce the risk of developing hip dysplasia, has fasteners to keep the swaddle from coming loose, and is fashioned in such a way that the swaddle isn'table to migrate over the infant's face.

The relevant prior art includes the following references:

| U.S. Pat. No. | Inventor | Issue/Publication Date |
|---|---|---|
| 7,587,769 | McDermott | Sep. 15, 2009 |
| 7,181,789 | Gatten | Feb. 27, 2007 |
| 7,043,783 | Gatten | May 16, 2006 |
| 6,868,566 | Gatten | Mar. 22, 2005 |
| 6,393,612 | Thach et al. | May 28, 2002 |
| 5,129,406 | Magnusen et al. | Jul. 14, 1992 |

SUMMARY OF THE INVENTION

A preferred embodiment of the present invention has two panels that can be made from fabric or material. The back panel is both wide and long enough to wrap both of the infant's arms, entirely, in the preferred position, at their sides. There is a piece of hook at each end of the back panel that attaches to loop in the center and on the back side of the back panel at the infant's back. There is loop at one end of the back panel for overlap when wrapping the arms of smaller infants. There is an extension of fabric or material on the back panel that is for bringing up between the infant's legs. A piece of hook is on the end of this extended piece of the back panel for attaching to the matching piece on the extension of the front panel. Pieces of loop are adjacent to the hook at the back panel ends and on the extension of the back panel for laundry tabs.

The front panel is both wide and long enough to wrap around the infant's torso and secured arms. There is a panel of loop fabric on the front and towards one end of the front panel. A piece of hook that is at the opposite end of the front panel attaches to the panel of loop fabric once it is wrapped around the infants torso and secured arms. A piece of loop is adjacent to the hook at the end of the front panel for a laundry tab. There is an extension of fabric or material on the front panel. Another piece of loop fabric is on the extended piece of the front panel and is for attaching the hook on the extended piece of the back panel that is brought up between the infant's legs.

To swaddle an infant using the present invention, the back panel is laid with the loop at the center and on the back side down. The infant is placed with his back where the loop is located on the opposite side of the back panel and with his armpits even with the top edge of the panel. The arm adjacent to the end of the back panel that has the loop for overlap is wrapped first by raising the infant's arm and bringing up the end of the back panel between the arm and chest. The arm is brought down to his side and the end of the back panel is wrapped around the outside of the arm and the hook is attached to the loop at his back. The other arm is wrapped the same way. The front panel is laid across the infant with the top edge even with the infant's armpits and then wrapped around the torso and secured arms. The hook at one end of the front panel is attached to the panel of loop fabric on the front panel. The extended portion of the back panel is brought up between the infant's legs and the hook on the extended portion of the back panel is attached to the loop fabric on the extended portion of the front panel. Both arms are restrained in the preferred position, at his sides, and the infant is securely swaddled.

The present invention allows the infant's arms to be restrained and his torso swaddled without being able to break out and wake himself. Gentle, even pressure is provided across the chest and abdominal area. The risk of overheating is reduced. Easy access for diaper changes is provided and the swaddle is unable to migrate over the infant's face, reducing the risk of suffocation.

Some benefits of the present invention may be obtained with a simplified embodiment consisting of using only a single panel of fabric or other material that is long and wide enough to wrap the infant's arms with a cut out for the legs and a wrapping portion to swaddle the infant's torso.

It would be advantageous to provide hook and loop at the ends of the back panel with loop in the center at the infant's back and provide hook and loop for use in securing the front panel around the infant's torso and secured arms.

It would also be advantageous to provide additional loop at the ends of the panel as laundry tabs. When washing the swaddle, the hook and loop laundry tabs are attached to protect other items in the washer from being snagged by the hook.

It would further be advantageous to provide easy access for diaper changes by using two separate panels that are attached by using either hook and loop, snaps or some other fastener.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
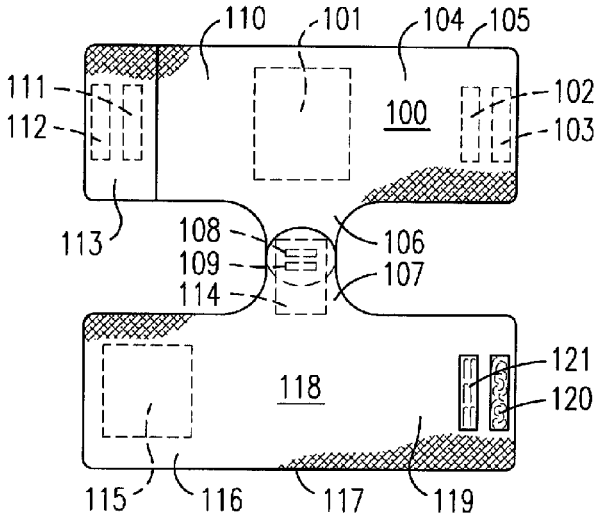
FIG. 1 is a plan front view of the preferred embodiment of the present invention.

FIG. 1 shows a preferred embodiment of the present invention having a back panel 100, a back loop panel 101, a first arm restraint 110, a strip of hook on the first arm restraint 112, a strip of loop on the first arm restraint 111, loop for overlap 113, a second arm restraint 104, a strip of hook on the second arm restraint 103, a strip of loop on the second arm restraint 102, a front panel 118, a first wrap end 116, a front loop panel 115, a second wrap end 119, a strip of hook on the second wrap end 121, a strip of loop on the second wrap end 120, a back panel extension 106, a hook for closure between legs 109, a strip of loop on the back panel extension 108, a front panel extension 107, and loop for closure between legs 114.

In this embodiment, the back panel 100 is long enough to cover the infant's arms from shoulder to beyond the fingertips and wide enough to wrap both of the infant's arms. The front panel 118 is long enough to cover the infant's torso from the shoulders to beyond the fingertips and wide enough to wrap the infant's torso and secured arms. The back panel extension 106 is long enough to reach the front panel extension 107 when brought up between the infant's legs. The front panel extension 107 is long enough to reach between the infant's legs. The back panel 100 and front panel 118 can also be made long enough and wide enough to secure the arms and swaddle the arms and torso of older and larger children or a person of any size.

The parts of the present invention are made from sheet material, usually fabric and hook and loop fasteners. Many fabrics known in the art may be used depending on the desired characteristics such as elasticity, warmth, weight, breathability, stain resistance, absence of allergens, visual appeal and other factors. The present invention may be made of a single material or parts may be made of different materials. Flexible, non-fabric materials may also be used to provide special characteristics.

The first arm restraint 110 extends from the back panel 100 and is long enough to wrap once from between the infant's first arm and chest and outward over the infant's arm with the end attaching to the back loop panel 101 on the back side of the back panel 100 with a strip of hook on the first arm restraint 112. The second arm restraint 104 extends from the back panel 100 and is long enough to wrap once from between the infant's second arm and chest and outward over the infant's arm with the end attaching to either the back loop panel 101 or the loop for overlap 113 with a strip of hook on the second arm restraint 103.

The first arm restraint 110, the second arm restraint 104 and the back panel extension 106 may be separate pieces sewn or attached by other means known in the art to the back panel 100, or the first arm restraint 110, the second arm restraint 104, the back panel extension 106 and the back panel 100 may be of a single, continuous piece of material.

The first wrap end 116, the second wrap end 119, and the front panel extension 107 may be separate pieces sewn or attached by other means known in the art to the front panel 118, or the first wrap end 116, the second wrap end 119, the front panel extension 107 and the front panel 118 may be of a single, continuous piece of material.

At the end and on the back side of the first arm restraint 110 there is a strip of hook on the first arm restraint 112 that attaches to the back loop panel 101 on the back side of the back panel 100. Adjacent to the strip of hook on the first arm restraint 112, there is a strip of loop on the first arm restraint 111 than can be attached to the strip of hook on the first arm restraint 112 to act as a laundry tab to protect other items being laundered at the same time. At the end and on the back side of the second arm restraint 104 there is a strip of hook on the second arm restraint 103 that attaches to the loop panel on the back side of the back panel 100. Adjacent to the strip of hook on the second arm restraint 103, there is a strip of loop on the second arm restraint 102 that can be attached to the strip of hook on the second arm restraint 103 to act as a laundry tab to protect other items being laundered at the same time.

At the center and on the back side of the back panel 100 there is a loop panel that is used to secure the first arm restraint 110 and the second arm restraint 104. Many other fabrics or materials may be used instead or in addition to perform as loop to secure the first arm restraint 110 and the second arm restraint 104. The loop panel is long and wide enough allow the first arm restraint 110 and the second arm restraint 104 to secure the arms of various sized infants, older children or a person of any size.

On the front side and at the end of the first arm restraint 110, there is loop for overlap 113 of the second arm restraint 104. In the case of a smaller infant, the first arm restraint 110 when wrapped around the infant's first arm and attached to the loop panel at the back panel 100, may have such excess that it uses the entire loop panel. The loop for overlap 113 of the second arm restraint 104 provides a place for the strip of hook on the second arm restraint 103 to attach to when the infant's second arm is wrapped. Many other fabrics or materials may be used instead or in addition to perform as loop to provide a place for the overlapping of the second arm restraint 104 to attach to. The position of the loop overlap may be reversed in any embodiment of the present invention without impairing the utility of the invention.

At the end of the front panel 118 is the first wrap end 116. When the front panel 118 is placed on the infant's torso, the first wrap end 116 is wrapped around the infant's torso and first secured arm to the infant's back. The first wrap end 116 is at least long enough to reach to the infant's back once wrapped around the infant's torso and first secured arm. The first wrap end 116 may be of any length in any embodiment of the present invention without impairing the utility of the invention. At the opposite end of the front panel 118 is the second wrap end 119. After the first wrap end 116 is wrapped around the torso and secured first arm of the infant, the second wrap end 119 is wrapped around the torso and secured second arm of the infant and attached to the first wrap end 116.

Near the end and on the back side of the first wrap end 116 there is a front loop panel 115 that is used to secure the second wrap end 119 to the first wrap end 116 after wrapping the infant's torso and secured arms. Many other fabrics or materials may be used instead or in addition to perform as loop to secure the second wrap end 119 to the first wrap end 116. The front loop panel 115 is long and wide enough to allow the front panel 118 to swaddle the torso and secured arms of various sized infants, older children or a person of any size. The position of the front loop panel 115 may be reversed in any embodiment of the present invention without impairing the utility of the invention.

At the end and on the front side of the second wrap end 119 there is a strip of hook on the second wrap end 121 that attaches to the front loop panel 115 on the back side of the front panel 118. Adjacent to the strip of hook on the second wrap end 121, there is a strip of loop on the second wrap end 120 that can be attached to the strip of hook on the second wrap end 121 to act as a laundry tab to protect other items being laundered at the same time. The position of the strip of hook on the second wrap end 121 and the strip of loop on the second wrap end 120 may be reversed in any embodiment of the present invention without impairing the utility of the invention.

On the back side of the front panel 118 there is a front loop panel 115. Once the first wrap end 116 has been wrapped around the infant's torso and first secured arm, the second wrap end 119 is wrapped around the infant's torso and second secured arm and attached to the front loop panel 115 to secure the swaddle. Many other fabrics or materials may be used instead or in addition to perform as loop to provide a place for the second wrap end 119 to attach to.

At the bottom and on the front side of the back panel extension 106 there is a hook for closure between legs 109 that attaches to the loop for closure between legs 114 on the back side of the front panel extension 107. Adjacent to the hook for closure between legs 109 there is a strip of loop on the back panel extension 108 that can be attached to the hook for closure between legs 109 to act as a laundry tab to protect other items being laundered at the same time.

On the back side of the front panel extension 107 there is a loop for closure between legs 114 that is used to secure the bottom portion of the swaddle to the back panel extension 106. Many other fabrics or materials may be used instead or in addition to perform as loop to provide a place for the hook for closure between legs 109 to attach to.

The hook for closure between legs 109 and the loop for closure between legs 114 may be switched between the back panel extension 106 and the front panel extension 107 in any embodiment of the present invention without impairing the utility of the invention.

It should be noted that some of the benefits of the present invention may be obtained with a simplified version consisting only of the back panel 100, the first arm restraint 110, the second arm restraint 104 and the front panel 118. However, the addition of the strip of hook on the first arm restraint 112, the strip of hook on the second arm restraint 103, the back loop panel 101 at the back of the back panel 100, the front loop panel 115, and the strip of hook on the second wrap end 121 allows a caregiver or parent to secure the infant's arms, and the front panel 118 so that they are unable to break out of the swaddle. The addition of the back panel extension 106, the hook for closure between legs 109, the front panel extension 107 and the loop for closure between legs 114 keeps the swaddle from migrating toward the infant's face and allows for easy access for diaper changes.

Figure 2:
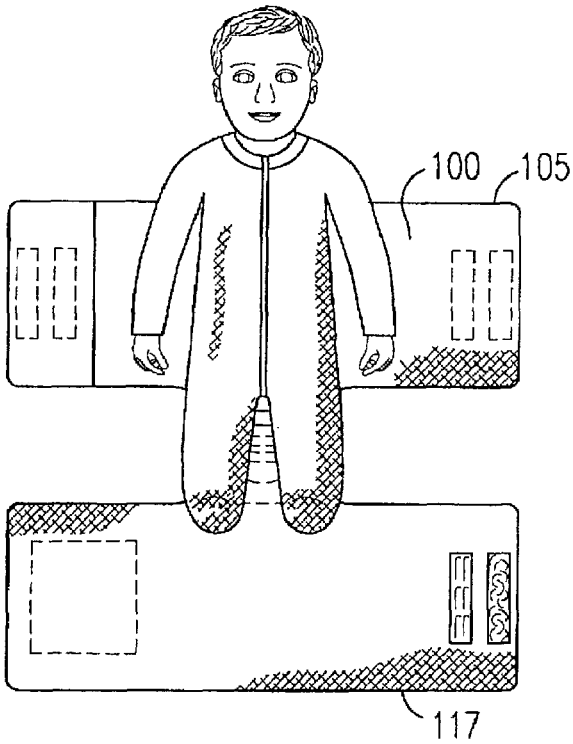
FIG. 2 is a plan front view of the embodiment of FIG. 1 as it would look with the infant placed on the back panel.

FIG. 2 shows the position of the infant when placed on the preferred embodiment of the present invention. The infant is placed such that his armpits are even with the top edge of back panel 105 with the back loop panel 101 (not visible) at his back, and with his arms along his sides.

FIG. 3, FIG. 4, FIG. 5 and FIG. 6 illustrate a preferred method for employing the preferred embodiment of the present invention.

Figure 3:
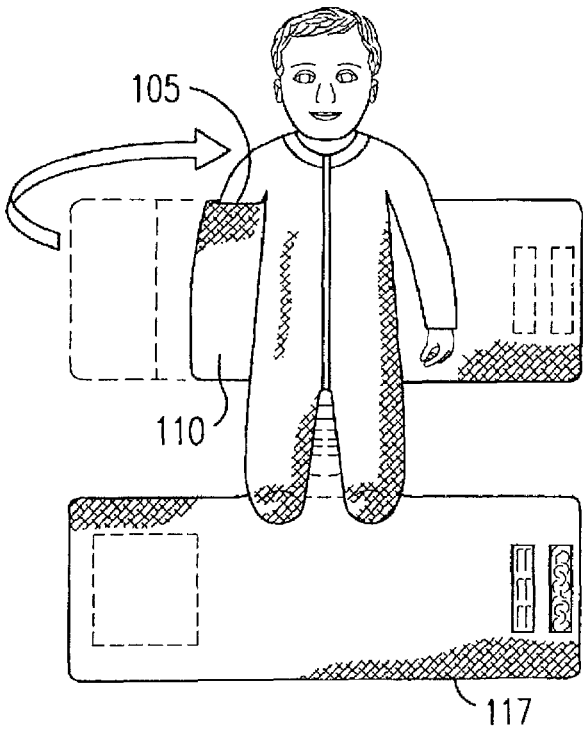
FIG. 3 is a plan front view of the embodiment of FIG. 1 with the first arm restraint wrapped around the infant's right arm and attached to the loop at the infant's back.

FIG. 3 shows an infant lying on the back panel 100 with his armpits aligned with the top edge of back panel 105, his arms along his sides and how his first arm is secured by wrapping the first arm restraint 110 around the first arm by bringing the first arm restraint 110 up between his chest and arm and wrapping the first arm restraint 110 outward over the arm and attaching the strip of hook on the first arm restraint 112 to the back loop panel 101 (not visible) on the back side of the back panel 100.

Figure 4:
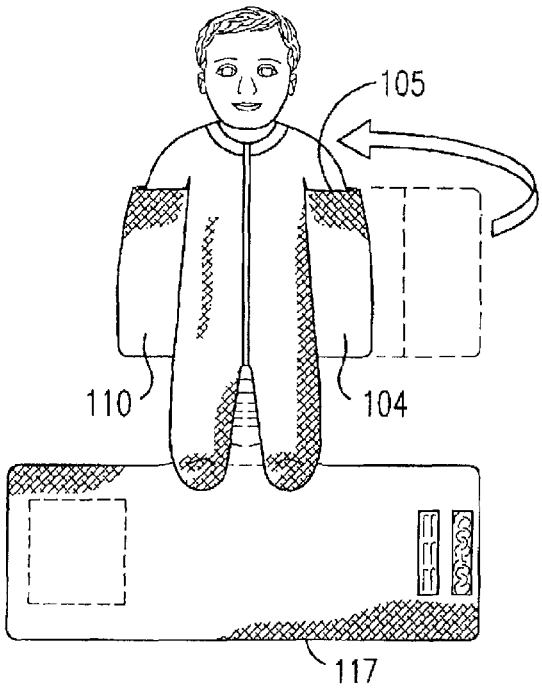
FIG. 4 is a plan front view of the embodiment of FIG. 1 with both of the infant's arms secured by the back panel.

FIG. 4 shows an infant lying on the back panel 100 with his armpits aligned with the top edge of panel, his arms along his sides, his first arm secured and how his second arm is secured by wrapping the second arm restraint 104 around the second arm by bringing the second arm restraint 104 up between his chest and arm and wrapping the second arm restraint 104 outward over the second arm and attaching the strip of hook on the second arm restraint 103 (not visible) either to the loop panel (not visible) on the back side of the back panel 100 or the loop for overlap 113, depending on the size of the infant or child. Both arms are now secured.

Figure 5:
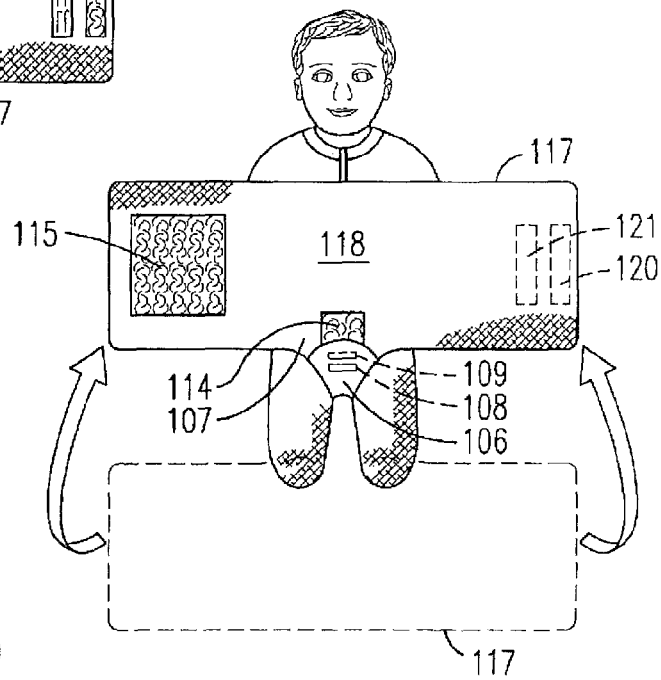
FIG. 5 is a plan front view of the embodiment of FIG. 1 with both of the infant's arms secured by the back panel and the front panel folded upward across the infant's torso.

FIG. 5 shows the position of the front panel 118 placed across the infant's torso with the top edge of front panel 117 even with the infant's armpits. The front panel extension 107 is placed downward between the legs, the back panel extension 106 is brought up between the legs and the hook for closure between legs 109 on the back panel extension 106 is attached to the loop for closure between legs 114 on the front panel extension 107.

Figure 6:
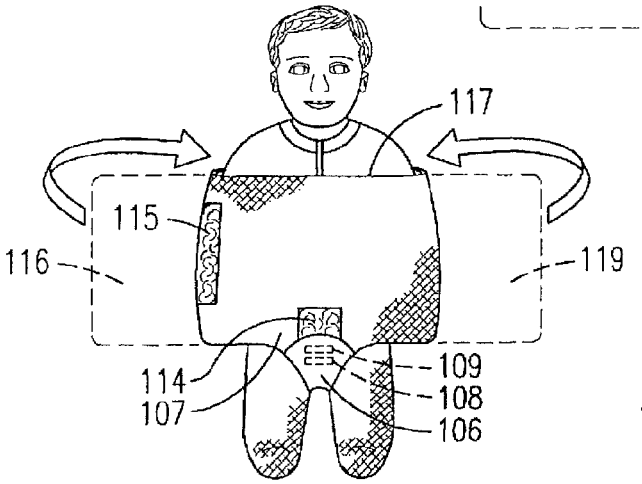
FIG. 6 is a plan front view of the embodiment of FIG. 1 with both of the infant's arms secured by the back panel and swaddled by front panel.

FIG. 6 shows an infant with both arms restrained (not visible) and how the infant's torso and secured arms are swaddled by wrapping the first wrap end 116 around to the infant's back and then wrapping the second wrap end 119 around to the infant's back and attaching the strip of hook on the second wrap end 121 to the front loop panel 115.

Figure 7:
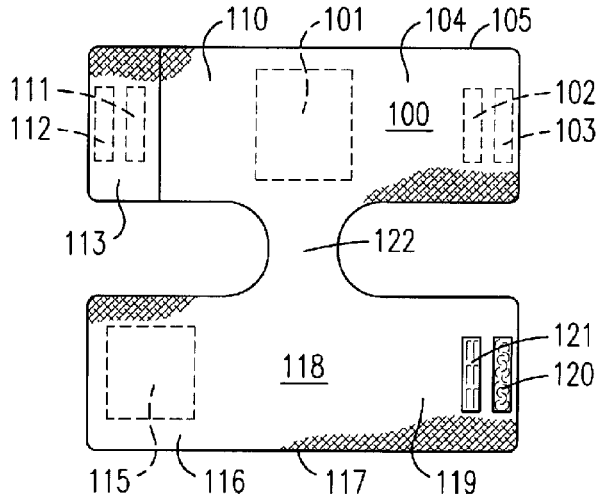
FIG. 7 is a plan front view of an alternate embodiment of the present invention using a single piece of fabric or material.

FIG. 7 shows an alternate embodiment of the present invention with the back panel 100, between legs panel 122 and front panel 118 as one continuous piece of fabric or material.

Figure 8:
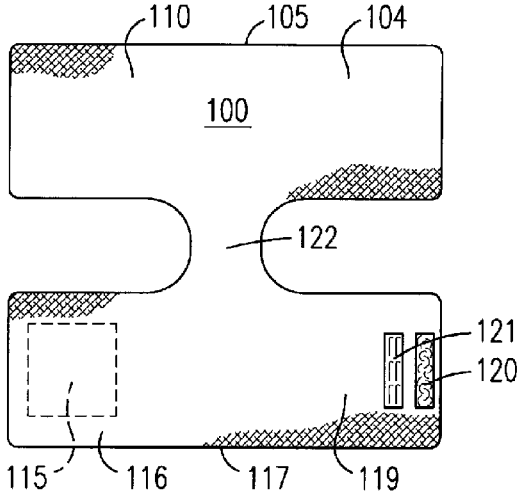
FIG. 8 is a plan front view of an alternate embodiment of the present invention using a single piece of fabric or material and without hook and loop fasteners to secure the arms.

FIG. 8 shows a simplified embodiment of the present invention without hook and loop fasteners for securing the first arm restraint 110 and the second arm restraint 104.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A swaddle comprising:

a back panel having a bottom edge, a top edge, a left edge, a right edge, a front surface and a rear surface;

a first arm restraint having a bottom edge, a top edge, a left edge, a right edge, a front surface and a rear surface, said first arm restraint extending from the left side of the back panel;

a second arm restraint having a bottom edge, a top edge, a left edge, a right edge, a front surface and a rear surface, said second arm restraint extending from the left side of the back panel;

a front panel having a bottom edge, a top edge, a left edge, a right edge, a front surface and a rear surface;

a between legs panel located between the bottom edge of the back panel and the top edge of the front panel, thereby connecting the back panel to the front panel;

said between legs panel having a width that is less than a width of the front panel;

said between legs panel having a width that is less than a width of the back panel;

at least one attachment means located on the front panel for attaching the left edge of the front panel to the right edge of the front panel.

2. The swaddle of claim 1 wherein:

said at least one attachment means is a hook and loop fastener.

3. The swaddle of claim 1 wherein:

said between legs panel further comprises a front panel extension extending upward from the top edge of the front panel;

a back panel extension extending downward from the bottom edge of the back panel; and an attachment means for attaching the front panel extension to the back panel extension.

4. The swaddle of claim 1 further comprising:

at least one attachment means located on the rear surface of the back panel;

at least one attachment means located on the rear surface of the first arm restraint; and at least attachment one means located on the rear surface of the second arm restraint.

5. The swaddle accessory of claim 1 further comprising:

at least one hook and loop fastener located on the rear surface of the back panel;

at least one hook and loop fastener located on the rear surface of the left arm restraint; and at least one hook and loop fastener located on the rear surface of the right arm restraint.

* * * * *